US011849874B2

(12) United States Patent
Li et al.

(10) Patent No.: US 11,849,874 B2
(45) Date of Patent: Dec. 26, 2023

(54) STORAGE ASSEMBLY FOR ISOLATION CLOTHING AND STORAGE ASSEMBLY FOR PROTECTION CLOTHING, CAPABLE OF BEING PUT ON AND TAKEN OFF QUICKLY

(71) Applicant: LIANGXI (BEIJING) TECHNOLOGY CO., LTD., Beijing (CN)

(72) Inventors: Shaoqiang Li, Beijing (CN); Lianchen Li, Beijing (CN); Yang Wu, Beijing (CN); Shuguang Wang, Beijing (CN); Bingyang Liu, Beijing (CN); Caixian Huang, Beijing (CN); Mingjun Gao, Beijing (CN); Zhengjun Gu, Beijing (CN)

(73) Assignee: Liangxi (Beijing) Technology Co., Ltd., Beijing (CN)

( * ) Notice: Subject to any disclaimer, the term of this patent is extended or adjusted under 35 U.S.C. 154(b) by 0 days.

(21) Appl. No.: 17/710,574

(22) Filed: Mar. 31, 2022

(65) Prior Publication Data

US 2022/0369840 A1 Nov. 24, 2022

(30) Foreign Application Priority Data

May 9, 2021 (CN) ..... 202120974832.9

(51) Int. Cl.
*A47G 25/90* (2006.01)

(52) U.S. Cl.
CPC ..... *A47G 25/90* (2013.01)

(58) Field of Classification Search
CPC .... A47G 25/90; A47G 25/904; A47G 25/905; A41D 13/12; A41D 13/129; B25J 11/00; B25J 11/008; B25J 11/009
See application file for complete search history.

(56) References Cited

U.S. PATENT DOCUMENTS 3,230,546 A * 1/1966 Sabee ..... A41D 13/1209 2/114
4,254,341 A * 3/1981 Herr ..... A61B 6/447 250/519.1
5,501,376 A * 3/1996 Roda-Balzarini ..... A47G 25/90 223/111

(Continued)

*Primary Examiner* — Ismael Izaguirre
(74) *Attorney, Agent, or Firm* — Katten Muchin Rosenman LLP

(57) ABSTRACT

The storage assembly for isolation clothing capable of being put on and taken off quickly includes: isolation clothing which includes an one-piece integrated protective clothing body, a putting-on and taking-off opening provided in one face of the protective clothing body which has a "大" shaped structure similar to a structure of the protective clothing body, and hasps and binding belts which are matched with each other and provided on two sides of the putting-on and taking-off opening; a storage rack which includes: a base plate, a vertical plate perpendicularly arranged on one side of the base plate, and two sets of supporting ribs which are provided on the vertical plate and parallel to the base plate; wherein fixing holes which are arranged at an outer side of each trouser leg and an outer side of each sleeve of the isolation clothing are sleeved on the supporting ribs.

18 Claims, 4 Drawing Sheets

(56) References Cited

U.S. PATENT DOCUMENTS

| | | | | |
|---|---|---|---|---|
| 5,624,154 | A * | 4/1997 | Kishi | A61B 46/10 297/188.2 |
| 6,170,721 | B1 * | 1/2001 | Chen | A47G 25/0671 223/94 |
| 8,608,022 | B1 * | 12/2013 | Kory | A47G 25/90 221/33 |
| 8,674,330 | B2 * | 3/2014 | Beck | A47B 83/00 250/516.1 |
| 8,960,493 | B1 * | 2/2015 | Dennison | A61B 42/50 221/33 |
| 9,687,032 | B2 * | 6/2017 | McBride | A41D 13/1209 |
| 9,861,537 | B2 * | 1/2018 | Louwrens | A41D 13/12 |
| 2007/0186515 | A1 * | 8/2007 | Ruetten | G07G 1/0036 211/85.15 |

* cited by examiner

STORAGE ASSEMBLY FOR ISOLATION CLOTHING AND STORAGE ASSEMBLY FOR PROTECTION CLOTHING, CAPABLE OF BEING PUT ON AND TAKEN OFF QUICKLY

CROSS REFERENCE TO RELATED APPLICATION

This patent application claims the benefit and priority of Chinese Patent Application No. 202120974832.9 filed on May 9, 2021, the disclosure of which is incorporated by reference herein in its entirety as part of the present application.

TECHNICAL FIELD

The embodiment of the present disclosure relates to the technical field of medical protective tools, and in particular to a storage assembly for isolation clothing capable of being put on and taken off quickly and a storage assembly for protection clothing capable of being put on and taken off quickly, the storage assembly for isolation clothing capable of being put on and taken off quickly is also called a storage assembly for protective clothing capable of being put on and taken off quickly.

BACKGROUND ART

In an epidemic area, a large number of patients come to hospitals in a short time, non-specialized medical staff also face reception and treatment of patients, and at the moment, whether the isolation clothing worn by the medical staff are convenient to wear or not and whether the isolation effect is good or not are of great importance.

Medical staff working in isolation wards of an infectious disease hospital, staff working in laboratories with strict level requirements or staff in special specified workplaces have high requirements on isolation effect of the isolation clothing for protecting human bodies, strict operation specification is required for daily wearing, existing isolation protective clothing cannot be put on quickly in case of emergencies due to the fact that they are made of flexible materials and are stacked up; furthermore, the operation method to take off the isolation clothing is not suitable after the work is finished; the skin of the stuff is prone to contact with bacteria or virus on the protective clothing upon not taking enough caution, and thus may be infected.

The most important protective measure for the stuff working in above situations is to wear the protective isolation clothing (also called protective clothing) correctly and effectively, and by a self-contained device for assisting to put on and take off, the risk of the wearer being contaminated when taking off the isolation clothing can be reduced effectively.

SUMMARY

In view of the above situations, the present disclosure provides a storage assembly for isolation clothing capable of being put on and taken off quickly and a storage assembly for protective clothing capable of being put on and taken off quickly, so as to solve the problems in the prior art that existing protection clothing cannot be put on and taken off quickly in an emergency due to their flexible materials and stack-up, and that the skin of the wearer may contact bacteria or virus on the outer surface of the isolation clothing when taking off the isolation clothing.

In order to achieve the objective above, it is provided the following technical solution.

In one aspect of the present disclosure, it is provided a storage assembly for isolation clothing capable of being put on and taken off quickly, also called a storage assembly for protective clothing capable of being put on and taken off quickly, including:

isolation clothing, called protective clothing, which includes: an one-piece integrated protective clothing body; a putting-on and taking-off opening provided in one face of the protective clothing body, which has a "大" shaped structure similar to a structure of the protective clothing body; and hasps and binding belts which are matched with each other and provided on two sides of the putting-on and taking-off opening;

a storage rack which includes: a base plate, a vertical plate perpendicularly arranged on one side of the base plate, and two sets of supporting ribs which are provided on the vertical plate and parallel to the base plate; and fixing holes which are arranged at an outer side of each trouser leg and an outer side of each sleeve of the isolation clothing are sleeved on the supporting ribs, and the isolation clothing is hung up in an unfolded state.

Furthermore, the putting-on and taking-off opening includes a main opening in an upper back of a trunk portion of the protective clothing body, upper openings in sleeves of the protective clothing body which are connected with the main opening, and lower openings in pantyhose of the protective clothing body which are connected with a bottom of the main opening; the main opening, the upper openings and the lower openings form an integrated opening.

Furthermore, a length of each upper opening is two thirds of that of each sleeve.

Furthermore, a length of each lower opening is two thirds of that of the pantyhose.

Furthermore, an end of the upper opening or the lower opening is provided with a cross locking thread structure.

Furthermore, the fixing holes are arranged in the sleeves and the pantyhose respectively, and located at middle positions of the sleeves and the pantyhose.

Furthermore, waist binding belts are arranged in a middle position of the protective clothing body.

Furthermore, tightening ropes are arranged at cuffs of the sleeves of the protective clothing body.

Furthermore, the storage assembly for protective clothing capable of being put on and taken off quickly further includes a stripping frame. The stripping frame includes a frame body and an upper support assembly, a lower support assembly and a hook assembly arranged on the frame body from top to bottom. The upper support assembly includes two upper support rods arranged symmetrically, the lower support assembly includes two lower support rods arranged symmetrically, and the hook assembly includes two support hooks arranged symmetrically, two sleeves of the protective clothing correspond to the two upper support rods one by one, the fixing holes on the two sleeves are hung on the upper support rods respectively, and two trouser legs of the protective clothing correspond to the two lower support rods one by one, the fixing holes on the two trouser legs are hung on the lower support rods respectively, two slipper socks of the protective clothing are provided with hook holes respectively, the two slipper socks correspond to the two support hooks one by one, and the hook holes of the two slipper socks are hooked on the support hooks respectively.

Furthermore, a signboard is arranged on the stripping frame.

According to the present disclosure, the storage assembly has the following advantages. The storage assembly includes: isolation clothing which includes an one-piece integrated protective clothing body, a putting-on and taking-off opening provided in one face of the protective clothing body which has a "大" shaped structure similar to a structure of the protective clothing body, and hasps and binding belts which are matched with each other and provided on two sides of the putting-on and taking-off opening; a storage rack which includes a base plate, a vertical plate perpendicularly arranged on one side of the base plate, and two sets of supporting ribs which are provided on the vertical plate and parallel to the base plate; fixing holes which are arranged on the isolation clothing are sleeved on the supporting ribs, and the isolation clothing are hung up in an unfolded state. The storage assembly enables the isolation clothing to hang on the storage rack in an unfolded state with the putting-on and taking-off opening facing outward, i.e. facing the wearer. The wearer can put on and take off the isolation clothing directly through the putting-on and taking-off opening via supporting of the storage rack for the isolation clothing, thereby preventing the wearer from contacting the outer surfaces and the inner surfaces of the contaminated isolation clothing, and reducing the risk of contaminating the wearer when taking off the isolation clothing. Furthermore, the protection measures that the wearer cannot be contaminated when putting on and taking off the isolation clothing can be improved, and the operation on putting on and taking off is convenient and efficient.

BRIEF DESCRIPTION OF THE DRAWINGS

In order to more clearly illustrate the embodiments of the present disclosure or the technical solutions in the prior art, the drawings, which are used in the embodiments or the prior art description, are briefly described below. Apparently, the drawings in the following description are merely exemplary. For an ordinary technical person in the art, other drawings can be obtained based on the provided drawings without paying creative efforts.

The structures, proportions, sizes and the like described in the specification are only used for description of the present disclosure, which are provided for those familiar with the technology to understand and read the present disclosure thoroughly, and not used for limiting the present disclosure; therefore, they have not substantial changes in the technical content. Without affecting the effects and objectives of the present disclosure, any modifications of the structure, changes of the proportional relation or adjustments of the size should be fallen within the scope and the spirit covered by the appended claims.

List of reference numbers: 1 isolation clothing body; 2 putting-on and taking-off opening; 2-1 main opening; 2-2 upper opening; 2-3 lower opening; 3 hasp; 4 binding belt; 5 fixing hole; 6 base plate; 7 vertical plate; 8 supporting rib; 9 locking thread structure; 10 waist binding belt; 11 tightening rope, 12 frame body, 13 upper support rod, 14 lower support rod, 15 support hook, 16 signboard.

DETAILED DESCRIPTION OF THE EMBODIMENTS

Embodiments of the present disclosure are illustrated below by the following detailed description, and other advantages and effects of the present disclosure can be easily appreciated by those skilled in the art from what is disclosed in this specification, and it is evident that the described embodiments are some, but not all, of the embodiments of the present disclosure. Based on the embodiments in the present disclosure, all other embodiments obtained by an ordinary technical person in the art without paying creative efforts belong to the scope of the present disclosure.

The terms such as "upper", "lower", "left", "right" and "middle", which are used in this specification, are also used for ease of description only and not used to limit the scope of the present disclosure; changes or adjustments of the terms in the relative relationships are considered to be within the scope of the present disclosure without substantial changes in the technical content.

Figure 1:
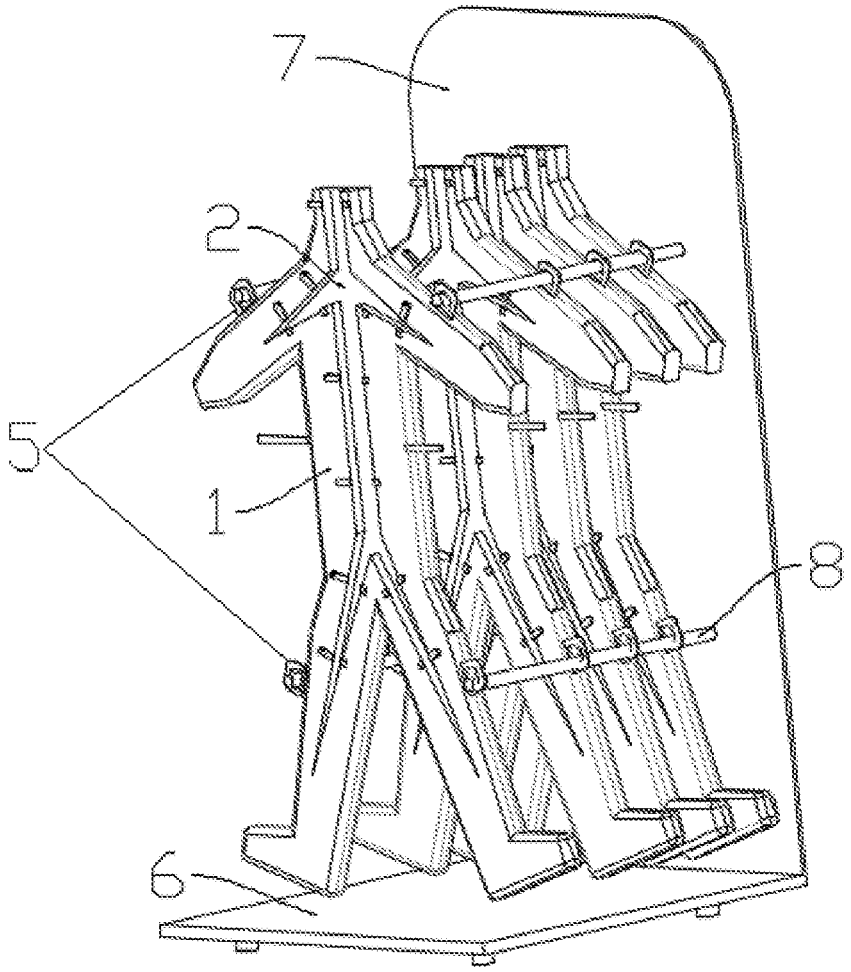
FIG. 1 is a three-dimensional diagram of a storage assembly for isolation clothing capable of being put on and taken off quickly according to an embodiment of the present disclosure.
Figure 2:
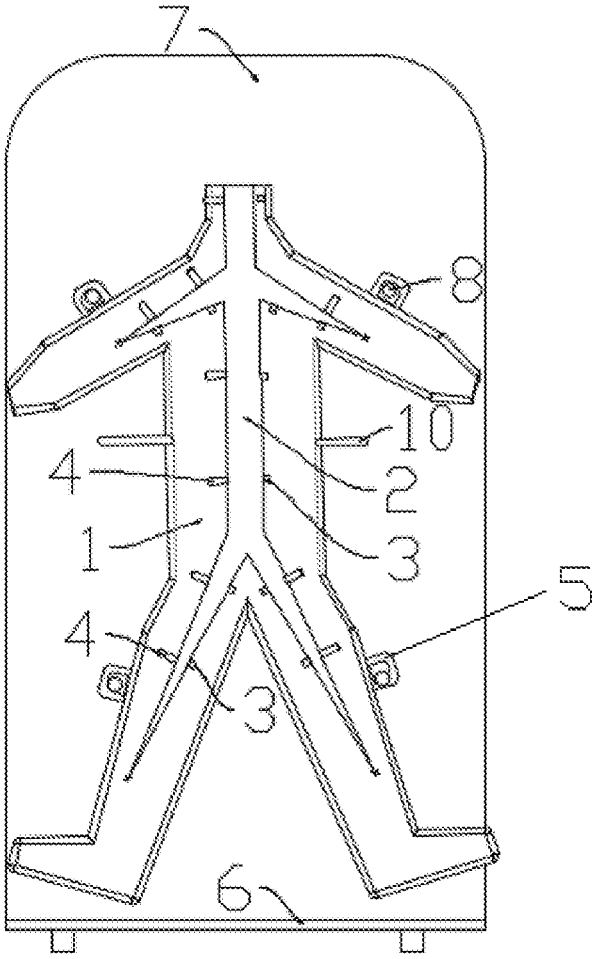
FIG. 2 is a front view of the storage assembly for isolation clothing capable of being put on and taken off quickly according to the embodiment of the present disclosure.

As shown in FIG. 1 and FIG. 2, it is provided a storage assembly for isolation clothing capable of being put on and taken off quickly according to one embodiment of the present disclosure, called a storage assembly for protective clothing capable of being put on and taken off quickly, including: isolation clothing, called protective clothing, which includes: an one-piece integrated protective clothing body 1; a putting-on and taking-off opening 2 provided in one face of the protective clothing body 1, which has a "大" shaped structure similar to a structure of the protective clothing body 1; hasps 3 and binding belts 4 which are matched with each other and provide on two sides of the putting-on and taking-off opening 2; a storage rack, which includes: a base plate 6, a vertical plate 7 perpendicularly arranged on one side of the base plate 6, and two sets of supporting ribs 8 which are provided on the vertical plate 7 and parallel to the base plate 6; fixing holes 5 which are arranged on the isolation clothing are sleeved on the supporting ribs 8, and the isolation clothing is hung up in an unfolded state.

In one embodiment, the protective clothing and the storage rack can be used as a set, and they can also be used separately.

In one embodiment, the isolation clothing is uniform in size. The protective clothing body 1 includes a trunk portion, sleeves and a pantyhose integrated with trouser legs and shoes. A form of the isolation clothing body 1 enables the isolation clothing to be directly hung on the storage rack in an unfolded state, with the putting-on and taking-off opening 2 facing outward, i.e. facing the wearer. A worker, also called a wearer, can put on and take off the isolation protective clothing directly through the putting-on and taking-off opening 2, thereby preventing hands from directly contacting an outer surface of the protective clothing, the putting-on and taking-off efficiency is effectively improved and putting-on and taking-off can be completed in the first time. Furthermore, the risk that the clothes and the skin of the wearer may be contaminated when taking off the isolation clothing can be reduced effectively.

Figure 3:
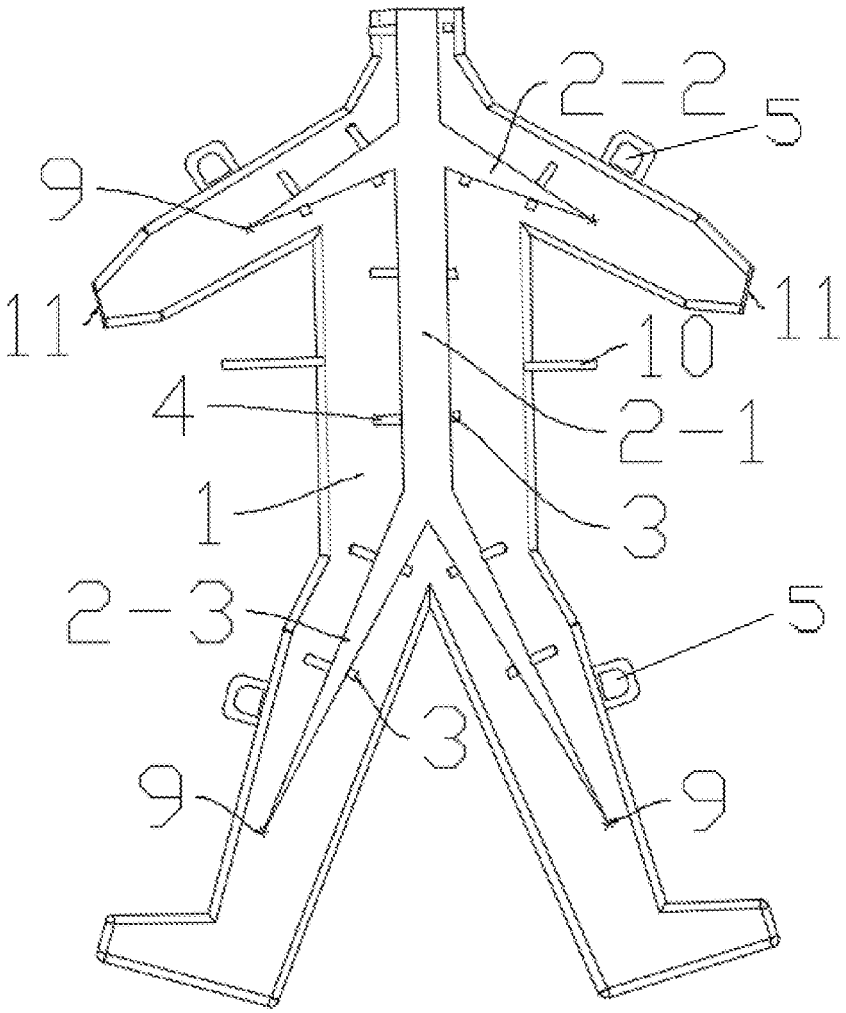
FIG. 3 is a front view of the isolation clothing in the storage assembly according to the embodiment of the present disclosure.

As shown in FIG. 3, the putting-on and taking-off opening 2 includes a main opening 2-1 in an upper back of the trunk portion of the protective clothing body 1, upper openings 2-2 in the sleeves of the protective clothing body 1 which is connected with the main opening 2-1, and lower openings in the pantyhose of the protective clothing body which is connected with a bottom of the main opening 2-1. The main opening 2-1, the upper openings 2-2 and lower openings 2-3 form an integrated opening 2, where the hasps 3 and the binding belts 4 are arranged on opposite positions at two sides of the putting-on and taking-off opening 2.

When in use, the worker directly stretches the legs into the pantyhose through the putting-on and taking-off openings 2, then stretches the arms into the sleeves, and fixes the hasps 3 and the binding belts 4 from the back, therefore, it is convenient and rapid to put on.

The binding belts 4 can be in the form of hook and loop fastener on the front side and the back side thereof. When in use, the binding belts 4 pass through the hasps and are tightened so as to be bonded and fixed. A blocking strip (not shown) can be arranged on one side of the hasp 3, and the blocking strip is also a form of hook and loop fastener. After the binding belts 4 are fixed, the blocking strip is pressed and bonded, so that an overall sealing performance is guaranteed.

The isolation clothing is opened in the back, which is convenient to put on and take off. The opening of the isolation clothing is of a "大" shaped structure. A back opening is provided from a collar to a back waist. An opening is provided each sleeve and crossed with the back opening, which is not through the cuff. The left and right trouser legs are respectively provided with an upward opening which communicates with the back opening at the waist, the upward opening is terminated at one-third section of the grouser leg above the pantyhose.

The fixing holes 5 are arranged at middle positions of left and right sleeves of the isolation clothing. The fixing holes 5 are also arranged at middle positions of the left and right trouser legs. The fixing holes 5 are connected with the sleeves and the trouser legs, and the fixing holes 5 are located on upper sides of the cuffs and the trouser legs respectively.

In a specific embodiment, the ends of the upper opening 2-2 or the lower opening 2-3 are provided with a cross-shaped locking thread structures 9 which can prevent edges of the putting-on and taking-off opening 2 from being torn due to excessive force.

Waist binding belts 10 are arranged in the middle of the protective clothing body 1, and tightening ropes 11 are arranged at the cuffs of the sleeves of the protective clothing body 1, so that the overall protecting effect of the isolation clothing is improved.

Figure 4:
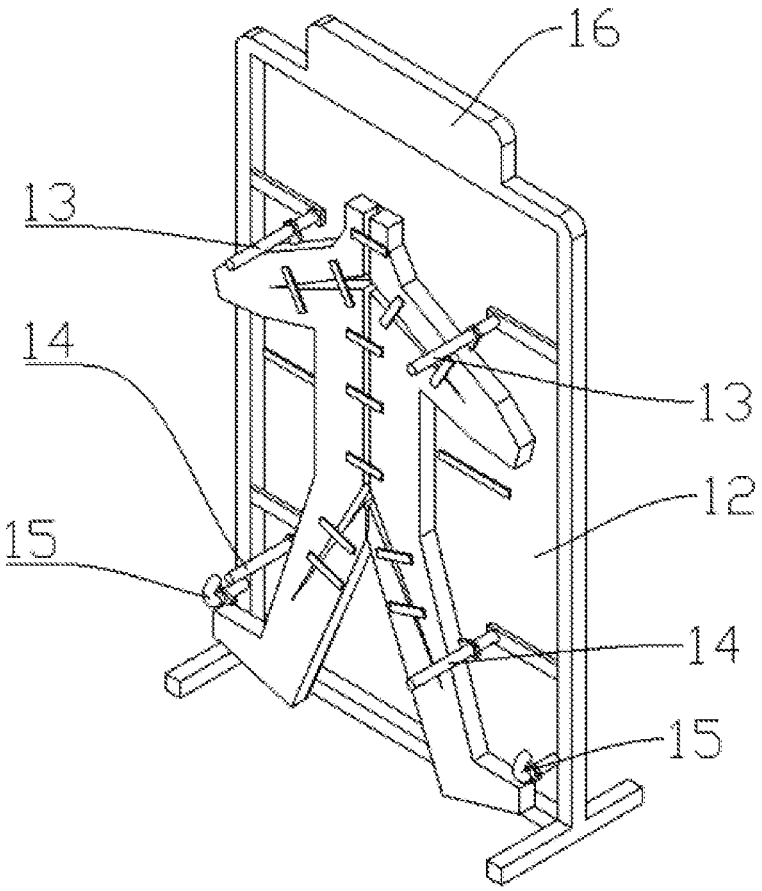
FIG. 4 is a schematic structural diagram of a stripping frame according to the present disclosure.

Referring to FIG. 4, the storage assembly for protective clothing capable of being put on and taken off quickly further includes a stripping frame. The stripping frame includes a frame body 12 and an upper support assembly, a lower support assembly and a hook assembly arranged on the frame body from top to bottom. The upper support assembly includes two upper support rods 13 arranged symmetrically, the lower support assembly includes two lower support rods 14 arranged symmetrically, and the hook assembly includes two support hooks 15 arranged symmetrically. Two sleeves of the protective clothing correspond to the two upper support rods 13 one by one, the fixing holes on the two sleeves are hung on the upper support rods respectively, and two trouser legs of the protective clothing correspond to the two lower support rods 14 one by one, the fixing holes on the two trouser legs are hung on the lower support rods 14 respectively. Two slipper socks of the protective clothing are provided with hook holes respectively, the two slipper socks correspond to the two support hooks 15 one by one, and the hook holes of the two slipper socks are hooked on the support hooks 15 respectively.

In actual use, putting on and taking off are carried out in rooms with different clean levels respectively. When putting on, the protective clothing is new, and multiple clothes can be placed with the help of the storage rack. Taking off the protective clothing is carried out in the contaminated room, and only a single piece of protective clothing is taken off, which can be with the help of storage rack. However, in order to facilitate taking off slipper socks, the stripping fame is used in the embodiment.

When taking off, the fixing holes on the two sleeves are respectively hung on the corresponding upper support rods 13, the fixing holes on the two trouser legs are respectively hung on the corresponding lower support rods 14, the hook holes of the two slipper socks are respectively hung on the corresponding support hooks 15, and then the wearer completes taking off from the back of the protective clothing, similar to "golden cicada peeling". At the same time, the contaminated surface of the contaminated protective clothing is rolled up inwardly.

The stripping fame is provided with a signboard 16, and the signboard is provided with identification words as required. For example, the signboard is provided with the words "platform for taking off protective clothing".

The protective clothing includes a coat and pantyhose. The pantyhose includes trousers and slipper socks. The coat, the trousers and the slipper socks are in one-piece structure.

Although the present disclosure has been described in detail above with the general description and the detailed embodiments, some modifications or improvements may be made thereto on the basis of the present disclosure, which are apparent to those skilled in the art. Therefore, such modifications or improvements without departing from the spirit of the present disclosure are intended to fall within the scope of the claimed disclosure.

What is claimed is:

1. A storage assembly for isolation clothing capable of being put on and taken off quickly, comprising:

isolation clothing which comprises:

an one-piece integrated protective clothing body comprising trouser legs and sleeves;

a putting-on and taking-off opening provided in one face of the protective clothing body, wherein the putting-on and taking-off opening has a shape extending towards the sleeves and the trouser legs; and hasps and binding belts which are matched with each other and provided on two sides of the putting-on and taking-off opening; and a storage rack which comprises: a base plate, a vertical plate perpendicularly arranged on one side of the base plate, and two sets of supporting ribs which are provided on the vertical plate and parallel to the base plate, wherein fixing holes which are arranged at an outer side of each of the trouser legs and an outer side of each of the sleeves of the isolation clothing respectively are configured to be sleeved on the supporting ribs so that, and the isolation clothing is hung up in an unfolded state.

2. The storage assembly according to claim 1, wherein the putting-on and taking-off opening comprises a main opening in an upper back of a trunk portion of the protective clothing body, upper openings in the sleeves of the protective clothing body which are connected with the main opening, and lower openings in a pantyhose integrated with the trouser legs of the protective clothing body which are connected with a bottom of the main opening; the main opening, the upper openings and the lower openings form an integrated opening.

3. The storage assembly according to claim 2, wherein a length of each upper opening is two thirds of a length of each of the sleeves.

4. The storage assembly according to claim 2, wherein a length of each lower opening is two thirds of a length of the pantyhose.

5. The storage assembly according to claim 4, wherein an end of the upper opening or the lower opening is provided with a cross locking thread structure.

6. The storage assembly according to claim 2, wherein the fixing holes are arranged in the sleeves and the pantyhose respectively, and located at middle positions of the sleeves and the pantyhose.

7. The storage assembly according to claim 1, wherein waist binding belts are arranged in a middle position of the protective clothing body.

8. The storage assembly according to claim 1, wherein tightening ropes are arranged at cuffs of the sleeves of the protective clothing body.

9. A storage assembly for protective clothing capable of being put on and taken off quickly, comprising:

protective clothing which comprises:

an one-piece integrated protective clothing body comprising two trouser legs and two sleeves;

a putting-on and taking-off opening provided in one face of the protective clothing body, wherein the putting-on and taking-off opening has a shape extending towards the sleeves and the trouser legs which; and hasps and binding belts which are matched with each other and provided on two sides of the putting-on and taking-off opening; and a storage rack which comprises: a base plate, a vertical plate perpendicularly arranged on one side of the base plate, and two sets of supporting ribs which are provided on the vertical plate and parallel to the base plate, wherein fixing holes which are arranged at an outer side of each of the trouser legs and an outer side of each of the sleeves of the protective clothing respectively are configured to be sleeved on the supporting ribs so that the protective clothing is hung up in an unfolded state.

10. The storage assembly according to claim 9, wherein the putting-on and taking-off opening comprises a main opening in an upper back of a trunk portion of the protective clothing body, upper openings in the sleeves of the protective clothing body which are connected with the main opening, and lower openings in a pantyhose integrated with the trouser legs of the protective clothing body which are connected with a bottom of the main opening; the main opening, the upper openings and the lower openings form an integrated opening.

11. The storage assembly according to claim 10, wherein a length of each upper opening is two thirds of a length of each of the sleeves.

12. The storage assembly according to claim 10, wherein a length of each lower opening is two thirds of a length of the pantyhose.

13. The storage assembly according to claim 12, wherein an end of the upper opening or the lower opening is provided with a cross locking thread structure.

14. The storage assembly according to claim 10, wherein the fixing holes are arranged in the sleeves and the pantyhose respectively, and located at middle positions of the sleeves and the pantyhose.

15. The storage assembly according to claim 9, wherein waist binding belts are arranged in a middle position of the protective clothing body.

16. The storage assembly according to claim 9, wherein tightening ropes are arranged at cuffs of the sleeves of the protective clothing body.

17. The storage assembly according to claim 9, further comprises a stripping frame which comprises a frame body, an upper support assembly, a lower support assembly and a hook assembly arranged on the frame body from top to bottom, wherein:

the upper support assembly comprises two upper support rods arranged symmetrically, the lower support assembly comprises two lower support rods arranged symmetrically, and the hook assembly comprises two support hooks arranged symmetrically, the two sleeves of the protective clothing correspond to the two upper support rods one by one, the fixing holes on the two sleeves are hung on the upper support rods respectively, and the two trouser legs of the protective clothing correspond to the two lower support rods one by one, the fixing holes on the two trouser legs are hung on the lower support rods respectively, two slipper socks of the protective clothing are provided with hook holes respectively, the two slipper socks correspond to the two support hooks one by one, and the hook holes of the two slipper socks are hooked on the support hooks respectively.

18. The storage assembly according to claim 17, wherein a signboard is arranged on the stripping frame.

* * * * *